US008746848B2

(12) United States Patent
Hays et al.

(10) Patent No.: US 8,746,848 B2
(45) Date of Patent: Jun. 10, 2014

(54) INK JET PRINTING SYSTEMS AND METHODS WITH PRE-FILL AND DIMPLE DESIGN

(71) Applicant: Xerox Corporation, Norwalk, CT (US)

(72) Inventors: Andrew W Hays, Fairport, NY (US); Richard P Germain, Webster, NY (US); Joseph A Degroot, Hamilton, MI (US); Peter J Nystrom, Webster, NY (US); Jun Ma, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/772,201

(22) Filed: Feb. 20, 2013

(65) Prior Publication Data

US 2013/0162723 A1 Jun. 27, 2013

Related U.S. Application Data

(62) Division of application No. 12/489,915, filed on Jun. 23, 2009, now Pat. No. 8,393,713.

(51) Int. Cl.
*B41J 2/04* (2006.01)

(52) U.S. Cl.
USPC ..... 347/54; 347/55; 347/10

(58) Field of Classification Search
USPC ..... 347/54, 55, 56, 5, 9, 10
See application file for complete search history.

(56) References Cited

U.S. PATENT DOCUMENTS

| | | | | |
|---|---|---|---|---|
| 6,193,343 | B1 | 2/2001 | Norigoe et al. | |
| 6,234,607 | B1 | 5/2001 | Sakai et al. | |
| 6,234,608 | B1 | 5/2001 | Genovese et al. | |
| 6,343,852 | B1 | 2/2002 | Yoon | |
| 6,491,378 | B2 * | 12/2002 | Fujii et al. | 347/54 |
| 7,387,364 | B2 * | 6/2008 | Silverbrook | 347/54 |
| 2007/0296766 | A1 * | 12/2007 | Watanabe | 347/54 |
| 2008/0204519 | A1 * | 8/2008 | Silverbrook | 347/54 |

* cited by examiner

*Primary Examiner* — Lam S Nguyen
(74) *Attorney, Agent, or Firm* — MH2 Technology Law Group LLP

(57) ABSTRACT

Systems and methods of ejecting ink drops from an inkjet printer are disclosed. The systems and methods can include a printhead with one or more actuators with associated nozzles and membranes. A voltage waveform can be applied to the actuators to fill the actuators with a volume of ink and eject the ink through the nozzles as ink drops. The voltage waveform can have associated pre-fill voltage to fill the actuator with ink and a firing voltage to eject the ink. The actuator membranes can have multi-height dimples to protect the membranes from contacting electrodes and reduce the electric field.

10 Claims, 10 Drawing Sheets

| DIMPLE1 (μm) | DIMPLE2 (μm) | WAVEFORM | FIELD (V/μm) | TTD (μs) | DROP SIZE (pL) |
|---|---|---|---|---|---|
| 0.5 | 0.5 | SINGLE | 404 | 256 | 7.2 |
| 0.5 | 0.7 | SINGLE | 292 | 284 | 6.8 |
| 0 | 0.7 | SINGLE | 292 | 304 | 6.9 |
| 0.7 | 0.7 | SINGLE | 287 | 220 | 6.2 |
| 0.5 | 0.5 | DUAL | 405 | 180 | 8.4 |
| 0.7 | 0.7 | DUAL | 291 | 240 | 6.5 |
| 0.5 | 0.7 | DUAL | 299 | 212 | 7.8 |

FIG. 7

INK JET PRINTING SYSTEMS AND METHODS WITH PRE-FILL AND DIMPLE DESIGN

CROSS-REFERENCE TO RELATED APPLICATIONS

This application is a divisional application of U.S. Application Ser. No. 12/489,915 filed Jun. 23, 2009, the entire disclosure of which is hereby incorporated herein by reference in its entirety.

FIELD OF THE INVENTION

The present invention generally relates to ink jet printing systems and methods with a pre-fill waveform application and a multi-height dimple.

BACKGROUND OF THE INVENTION

In a conventional inkjet printer, a printhead has a series of actuators out of which the printing fluid or ink ejects to an image receiving substrate. The ink drop mass, or size, and drop speed, or velocity, can influence the quality of the printing. Further, a variation in drop speed across the series of actuators can affect the quality of the printing, as drop speed variation can lead to poor image quality. The drop speed variation of an actuator due to actuation of neighboring actuators is known as crosstalk.

Conventional membrane-based inkjet printers rely on a two-part process for jetting: first, ink is drawn into the actuator when a membrane is electrostatically pulled down; and second, the ink is ejected from the actuator nozzle when the membrane is released. The pulldown and release is achieved by applying an amplified square waveform to the actuator. In particular, the square waveform comprises a high voltage that acts to pull down the membrane and fill the actuator with ink, followed by an application of 0 V to release the membrane and eject the ink. During the application of the square waveform, a pressure transient is transmitted to the ink feed behind the actuators, which affects the amount of pulldown of neighboring membranes, which in turn causes the ink drop speed to vary across the actuators.

Furthermore, the membranes in actuators conventionally include a dimple of uniform height that runs along the entire length of the membrane. The dimple can come to rest on a landing pad when the membrane is pulled down to prevent the membrane from contacting electrodes that transmit the voltages to the actuators. When the dimple comes to rest on the landing pad, a high electrical field can develop and damage to the actuator can occur.

Thus, there is a need for a voltage wave form that reduces pressure transients across the series of actuators and prevents the membrane from excessively pulling down. Further, there is a need for a dimple implementation to reduce conditions that lead to damage to the actuators.

SUMMARY OF THE INVENTION

In accordance with the present teachings, a method of ejecting ink drops from an ink jet printer is provided. The method provides an actuator comprising a nozzle, wherein the actuator is configured to eject an ink drop. The method further applies a voltage waveform to the actuator, wherein the voltage waveform comprises a pre-fill voltage configured to fill the actuator with a volume of ink, and a firing voltage configured to eject the ink drop through the nozzle.

In accordance with the present teachings, an inkjet printing system is provided. The inkjet printing system comprises an actuator configured to eject an ink drop, wherein the actuator comprises a nozzle. The inkjet printing system further comprises a voltage source configured to apply a voltage waveform to the actuator, wherein the voltage waveform comprises a pre-fill voltage configured to fill the actuator with a volume of ink, and a firing voltage configured to eject the ink drop through the nozzle.

In accordance with the present teachings, an inkjet printing system is provided. The inkjet printing system comprises an actuator with a membrane and a dimple, wherein the dimple comprises a first section laterally extending on a first region of the membrane and a second section laterally extending on a second region of the membrane, and wherein the first section has an associated height greater than an associated height of the second section. The inkjet printing system further comprises a voltage source configured to apply a voltage waveform to the actuator.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

BRIEF DESCRIPTION OF THE DRAWINGS

FIG. 7 is a chart detailing modeling results for different dimple configurations and waveforms.

DESCRIPTION OF THE EMBODIMENTS

Figure 1:
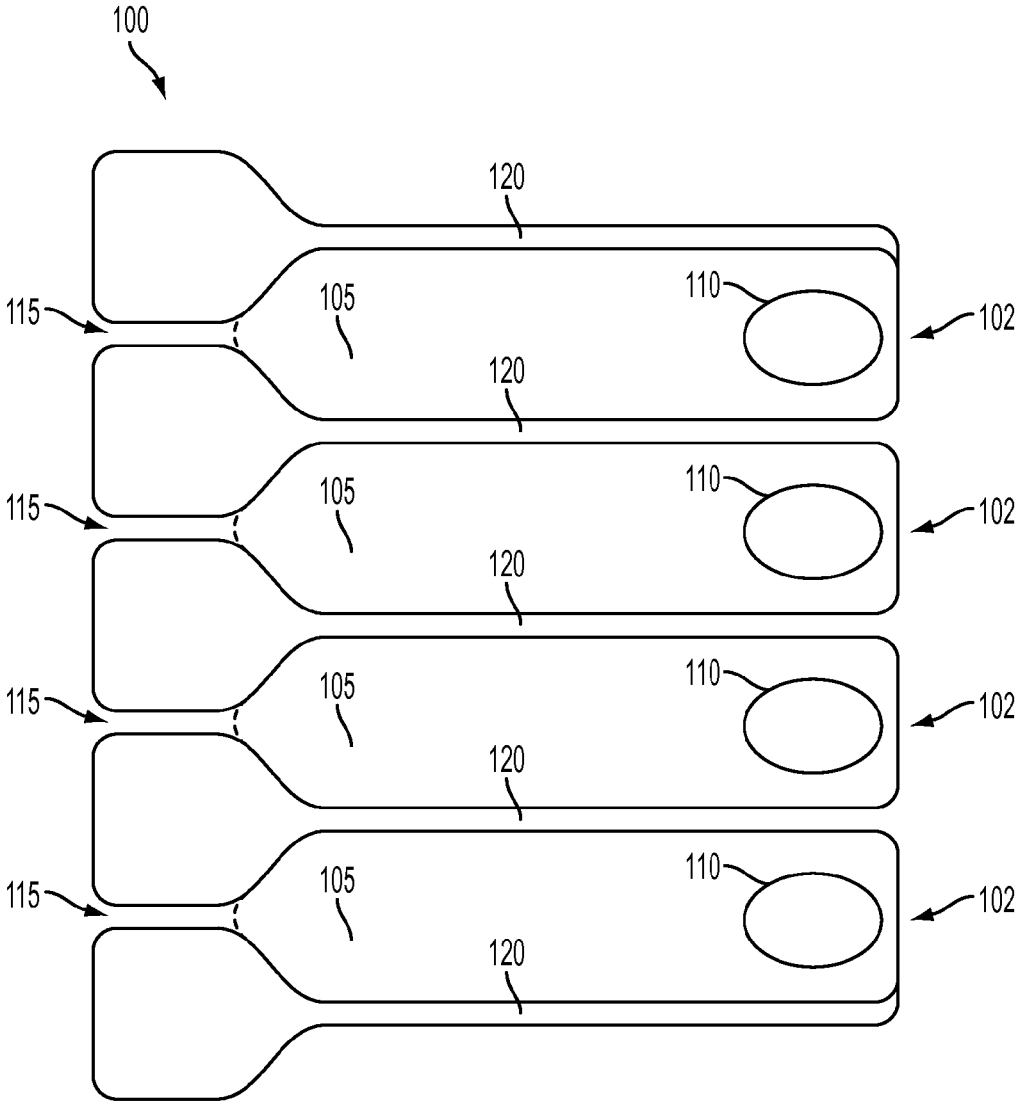
FIG. 1 depicts an exemplary actuator system within a printhead of an inkjet printer according to the present teachings.

Reference will now be made in detail to the exemplary embodiments of the invention, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

It should be appreciated that the exemplary systems and methods depicted in FIGS. 1, 2A, 2B, 3A-3D, 4, 5A-5C, 6, and 7 can be employed for any inkjet printer where ink is delivered through a nozzle or aperture to an image receiving substrate, for example in a MEMSJet or piezo inkjet and solid ink systems as known in the art. The ink can be delivered through an actuator of a printhead or a similar component. The exemplary systems and methods describe a pre-fill waveform application and multi-height dimple to reduce ink drop crosstalk and prevent actuator damage.

The exemplary systems and methods can comprise a printhead comprising at least two actuators through which the ink can exit the printhead. Each of the actuators can comprise an ink feed and a nozzle. Ink can enter the actuator through the ink feed and exit the actuator through the nozzle as a result of a voltage waveform being applied to the actuator. Conventional square waveforms result in a negative pressure transient being transmitted across the array of actuators, which affects the uniformity of ejected ink drop speed and results in crosstalk. The present exemplary systems and methods describe the implementation of a pre-fill, multi-level waveform being applied to the actuator that can pre-fill the actuator with a volume of ink before the ink is ejected, and reduce both the peak flow rate of the ink and the crosstalk effect.

The pre-fill waveform as described herein can comprise a pre-fill voltage in a range of about 130 V to about 150 V, a firing voltage in a range of about 180 V to about 220 V, and a gap voltage of about 0 V. It should be appreciated that other ranges and values of voltages in the pre-fill waveform can achieve the desired effects depending on the inkjet printer, the printhead, the actuator, the type and properties of the ink used, the comprising materials, and other factors.

The exemplary systems and methods can further comprise a membrane with a dimple laterally extending thereto. The dimple can prevent the membrane from contacting the electrodes that transmit the waveforms to the actuators. A high electrical field and damage to the actuator can result when the dimple comes to rest on a landing pad located between the electrodes, or if the created electrical field exceeds the maximum tolerable electrical field. The present exemplary systems and methods describe the implementation of a multi-height dimple that can reduce the amount of time and membrane area at high electrical field. Further, a multi-height waveform can be employed to maintain the electrical field below the maximum tolerable electrical field.

The multi-height dimple can comprise a first section with an associated height of about 0.65 μm to about 0.75 μm, and a second section with an associated height of about 0.45 μm to about 0.55 μm. Further, the multi-height waveform can comprise a first voltage applied for a first amount of time and a step-down voltage applied for a second amount of time. It should be appreciated that other ranges and values of dimple heights and voltages in the exemplary systems and methods can achieve the desired effects depending on the inkjet printer, the printhead, the actuator, the membrane, the type and properties of the ink used, the comprising materials, and other factors.

FIG. 1 depicts an exemplary actuator system 100 within a printhead of an inkjet printer. The actuator system 100 can include a plurality of actuators 102 that can each be configured to eject ink drops from the printhead and onto an image receiving substrate. Each of the plurality of actuators 102 can eject drops independently or in combination with the other of the plurality of actuators 102 depending on the configuration of the print job. The plurality of actuators can be separated by a plurality of walls 120.

Each of the plurality of actuators 102 can include a polysilicon membrane 105 that can be configured to contain ink in a channel above the polysilicon membrane 105. The polysilicon membrane 105 as depicted is merely exemplary and can comprise any suitable combination of materials and sizes. The polysilicon membrane 105 can further be configured to be electrostatically pulled down toward an electrode (not shown in FIG. 1) and then released. When the polysilicon membrane 105 is pulled down towards the electrode, ink can enter the channel through an ink feed 115 located at one end of each of the plurality of actuators 102. When the polysilicon membrane 105 is released, ink present within the channel can be ejected from the respective actuator 102. A nozzle 110 can be located on an end of the respective actuator 102 opposite to that of the ink feed 115.

Figure 2A:
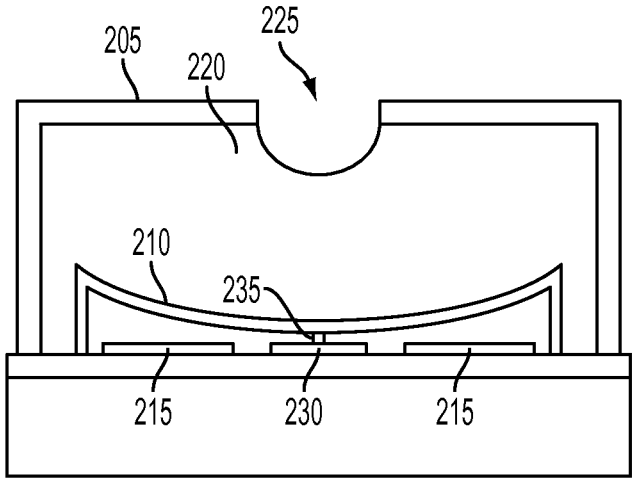
FIG. 2A depicts a cross section of an exemplary actuator of an ink jet printer according to the present teachings.
Figure 2B:
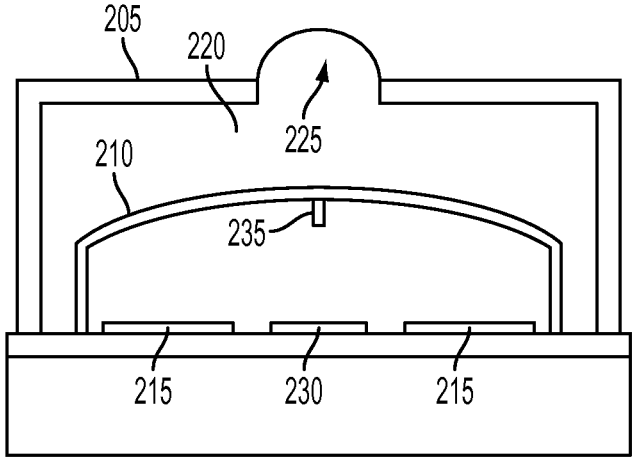
FIG. 2B depicts a cross section of an exemplary actuator of an ink jet printer according to the present teachings.

FIGS. 2A and 2B depict a cross section of an exemplary actuator 205 of an ink jet printer. The actuator 205 can include a polysilicon membrane 210 and a set of electrodes 215. Ink 220 can enter the actuator 205 through an ink feed, as described herein. A voltage waveform can be applied across the set of electrodes 215 that can result in an excitation pulse which can cause the polysilicon membrane 210 to be electrostatically pulled down towards the set of electrodes 215, as shown in FIG. 2A. It should be appreciated that the set of electrodes 215 can be in any combination or location within the actuator.

When the polysilicon membrane 210 is pulled down towards the set of electrodes 215, the pressure within the actuator 205 can decrease and the amount of ink 220 can increase in the area above the polysilicon membrane 210. Further, in various embodiments, the demand for ink in the actuator 205 can induce a negative pressure transient in the ink feed. The pulldown process can occur on a time scale of microseconds and a volume scale of 10 s of picoliters. In various embodiments, peak flow rates in the channel above the polysilicon membrane 210 can be as high as 10 μl/second.

When the voltage across the set of electrodes 215 is removed, the polysilicon membrane 210 can release, as shown in FIG. 2B. When the polysilicon membrane 210 releases, the ink 220 present in the channel above the polysilicon membrane 210 can be pushed out of the actuator 205 as ink drops through a nozzle 225 by the pressure generated by the release of the polysilicon membrane 210.

The pulldown process of the polysilicon membrane 210 is unstable and leads to a "runaway" condition where the polysilicon membrane 210 snaps down. The actuator 205 can include a dimple 235 and a landing pad 230 to limit the "runaway" condition, to ensure that the polysilicon membrane 210 does not touch the electrode, and to prevent other conditions and hazards. In various embodiments, the landing pad 230 can be located between the set of electrodes 215, and the dimple 235 can be located on the underside of the polysilicon membrane 210, as shown in FIGS. 2A and 2B. Further, the dimple 235 can be configured to extend the length of the polysilicon membrane 210. During the ink ejecting process, the dimple 235 can be configured to touch down on the landing pad 230 to absorb the force of the pulldown of the polysilicon membrane 210.

The pulldown process can further cause a high electrical field to develop in the actuator 205 and damage to the actuator 205 and the components therein can occur. Further, the pulldown process can lead to performance degradation and other effects. As such, the actuator 205 can have an associated maximum tolerable electrical field before the damage and performance degradation can likely occur. For example, the maximum tolerable electrical field can be about 300 volts per micrometer (V/μm).

The dimple 235 can have a height based on the maximum tolerable electrical field. For example, if the maximum tolerable electrical field is 300 V/μm, and the voltage for the excitation pulse of the waveform is 200 V, then the height of the dimple 235 would need to be (200 V)/(300 V/μm), or about 0.67 μm. In various embodiments, the polysilicon membrane 210 can pull down in a non-uniform manner over the length of the actuator 205. For example, the polysilicon membrane 220 can first pull down at the ends of the actuator 205, for example near the ink feed and the nozzle 225. As a result, a high electrical field develops in the regions where the polysilicon membrane 220 first pulls down, as the polysilicon membrane 220 can be in closest proximity to the set of electrodes 215 for the longest amount of time during the voltage waveform firing period, thereby increasing the likelihood for damage and performance degradation.

Further, the polysilicon membrane 210 can have a region where the associated dimple 235 can touch down after the voltage waveform is removed. As a result, in this region, the dimple can be eliminated or reduced in height relative to the dimple height in the high electrical field region. Accordingly, the present systems and methods can include a dimple 235 of varying heights across the length of the dimple 235. The height of the dimple 235 along the length of the actuator 205 can be determined by a firing waveform, membrane dynamics, and the maximum tolerable electrical field.

Figure 3A:
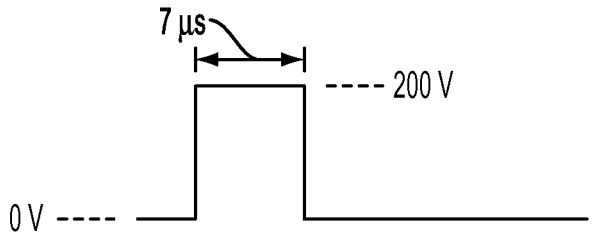
FIG. 3A depicts an exemplary waveform that can be applied to one or more actuators according to the present teachings.
Figure 3B:
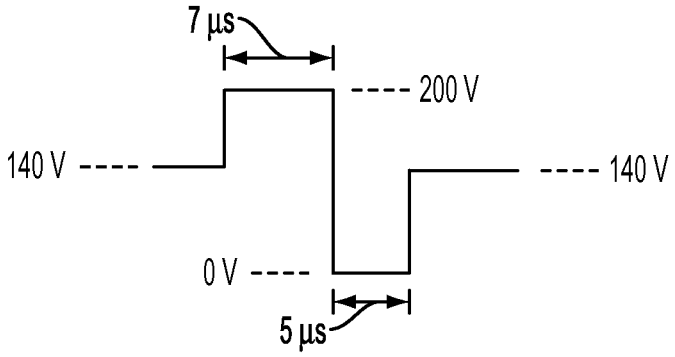
FIG. 3B depicts an exemplary waveform that can be applied to one or more actuators according to the present teachings.
Figure 3C:
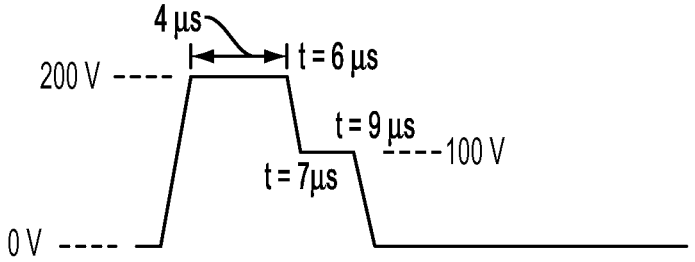
FIG. 3C depicts an exemplary waveform that can be applied to one or more actuators according to the present teachings.

FIGS. 3A-3C depict various exemplary waveforms that can be applied to one or more actuators in a printhead. In conventional actuators, an amplified square waveform, as shown in FIG. 3A, is applied to the actuator to achieve the pulldown and release cycle. The amplified square waveform can consist of a high voltage pulse of a specified length, called the firing voltage, followed by 0 V for a specified time, called the gap voltage. For example, as shown in FIG. 3A, a high voltage pulse of 200 V can be applied to the actuator for a firing voltage of 7 μs, followed by 0V until the cycle can repeat with another 200 V high voltage pulse. It should be appreciated that other time and voltage values can be implemented in the square waveform to achieve similar results.

If an amplified square waveform is applied to an actuator, the polysilicon membrane can be pulled down substantially during the high voltage pulse, and can then be released as the voltage goes to 0 V. Further, with an amplified square waveform, a negative pressure transient can be transmitted to the ink feeds traversing the entire length of the printhead chip behind the actuators. When the printhead is firing multiple actuators, the negative pressure transient can affect neighboring jets and the amount of pulldown across the actuators can be reduced. As a result, the drop velocity of the ejected ink can vary depending on the number of firing actuators, leading to the crosstalk condition. Further, drop velocity variation and crosstalk can lead to poor image quality.

The present systems and methods propose a modified pre-fill waveform to be applied to one or more actuators, as shown in FIG. 3B. In the pre-fill waveform, after the ink drop is ejected from the actuator, a DC voltage can be applied to the actuator for the remainder of the jetting cycle which can act to partially pull down the polysilicon membrane to draw ink into the actuator and reduce peak demand for ink during the pulldown process. For example, as shown in FIG. 3B, a pre-fill voltage of 140 V can be applied until a high voltage pulse of 200 V is applied for about 7 μs. After the high voltage pulse is applied, 0 V is applied for a time of about 5 μs, until the pre-fill voltage of 140 V is again applied until the next high voltage pulse. It should be appreciated that other time and voltage values can be implemented in the pre-fill waveform to achieve similar results.

The partial pulldown process resulting from the pre-fill voltage application can draw ink into the actuator 205 over a longer period of time than if the entire pulldown process was to be performed at the instant the high voltage pulse was applied (i.e. square waveform). Further, peak ink flow rate can be reduced and the corresponding negative pressure transient in the ink feed behind the jets can be reduced, thereby reducing disturbances to jetting and the crosstalk effect. Further, the pre-fill voltage can pull down the polysilicon membrane so that the dimple rests on the landing pad, but at a lower voltage than at which the dimple would rest during the high voltage pulse.

FIG. 3C depicts a multi-height waveform that can be applied to an actuator to be used in conjunction with a profiled, multi-height dimple. As described herein, the polysilicon membrane can pull down first at the ink feed end of the actuator.

As such, a high voltage can be applied to the actuator for a period during which the polysilicon membrane near the ink feed pulls down. After the period, during which the polysilicon membrane away from the ink feed can be pulled down, the applied voltage can be reduced. The dimple height near the ink feed can be taller than the height of the dimple away from the ink feed to account for the reduction voltage and the maintenance of the electrical field below the maximum tolerable value.

For example, as shown in FIG. 3C, a 200 V high voltage can be applied for about 4 μs, after which a 100 V reduced voltage can be applied for about 2 μs. After the 100 V reduced voltage is applied, the applied voltage can drop to 0 V before the cycle repeats. It should be appreciated that other time and voltage values can be implemented in the multi-height waveform to achieve similar results. Because the region of the polysilicon membrane near the ink feed pulls down before the region away from the ink feed, a taller dimple can be utilized in the region near the ink feed, and a shorter dimple can be utilized in the region away from the ink feed.

Further, because the applied voltage is either reduced or off by the time the polysilicon membrane is pulled down in the region away from the ink feed (and near the nozzle), the polysilicon membrane can more closely approach the electrodes without exceeding the maximum electric field. For example, if the multi-height waveform comprised an initial 200 V level with a step down to 100 V and the maximum allowed field was 300 V/μm, then a tall dimple with a height of about 0.67 μm ((200 V)/(300 V/μm)) can be used in the region that absorbs the 200 V level, and a short dimple with a height of about 0.33 μm ((100 V)/(300 V/μm)) can be used in the region of the polysilicon membrane that absorbs the 100 V level to make sure that the electric field stays below 300 V/μm. The utilization of the short dimple reduces the time during which the dimple can come to rest against the landing pad during the application of the voltage, thereby reducing the high electrical field effect and subsequent damage.

Figure 3D:
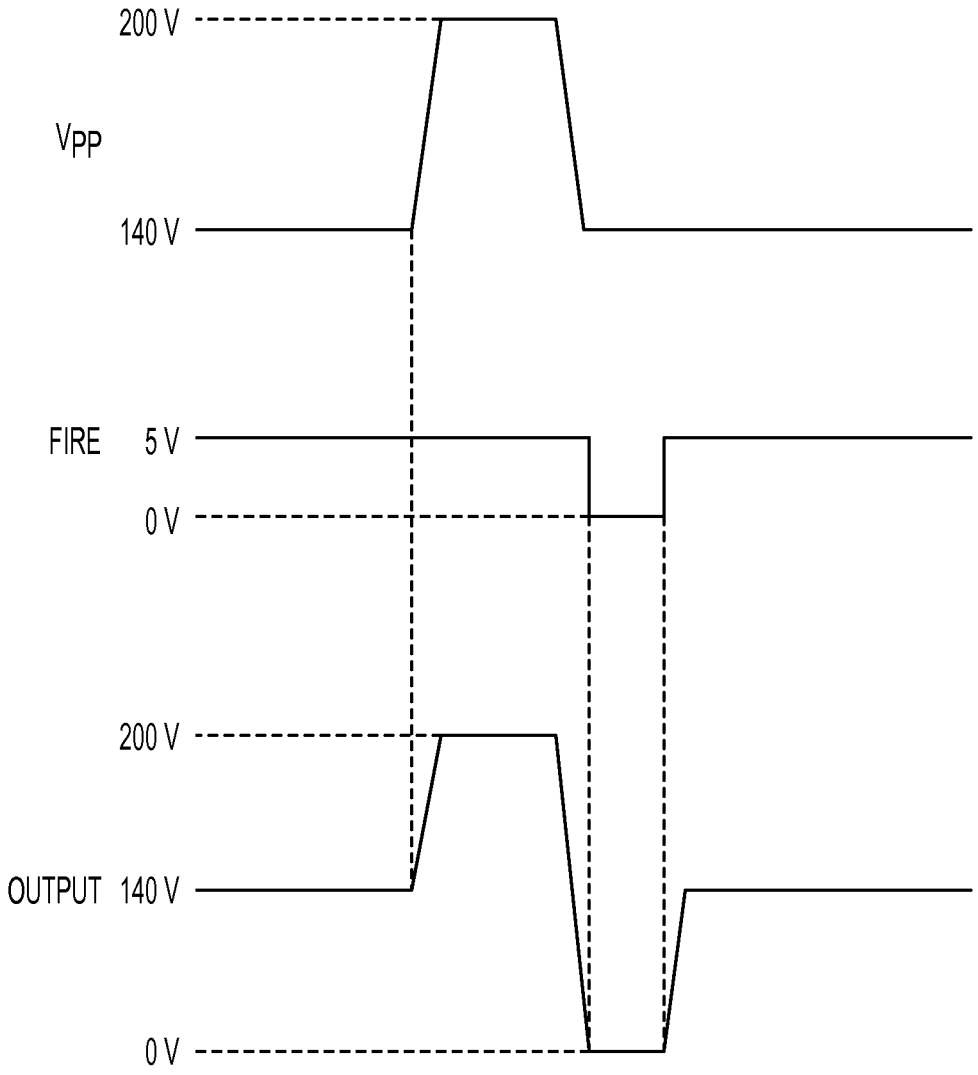
FIG. 3D depicts an exemplary implementation of a waveform that can be applied to one or more actuators according to the present teachings.

FIG. 3D depicts an exemplary implementation of a waveform that can be applied to one or more actuators. The exemplary implementation can be for the pre-fill waveform, as discussed herein and shown in FIG. 3B, and can be achieved using a conventional driver chip of a MEMSJet ink jet printer. Two of the inputs of the driver chip can be the V(pp) input and the FIRE input, as shown in FIG. 3D. The output of the driver is depicted in the lower graph of FIG. 3D. In operation, a logic high applied to the FIRE input can connect the output of the driver to V(pp). Further, a logic low applied to the FIRE input can connect the output of the driver to ground.

To produce the pre-fill waveform, the V(pp) signal can be modified to include a DC bias (the pre-fill voltage) and a high voltage pulse. For example, as shown in FIG. 3D, the DC bias can be 140 V and the high voltage pulse can be 200 V, although it should be appreciated that other voltages can be implemented. Further, the FIRE signal can be modified to always be a logic high (connecting V(pp) to the output) except for the time after the high voltage pulse where the FIRE signal is a logic low. The combination of the described V(pp) signal and FIRE input can produce the desired output pre-fill waveform, as depicted in the lower graph of FIG. 3D.

Figure 4:
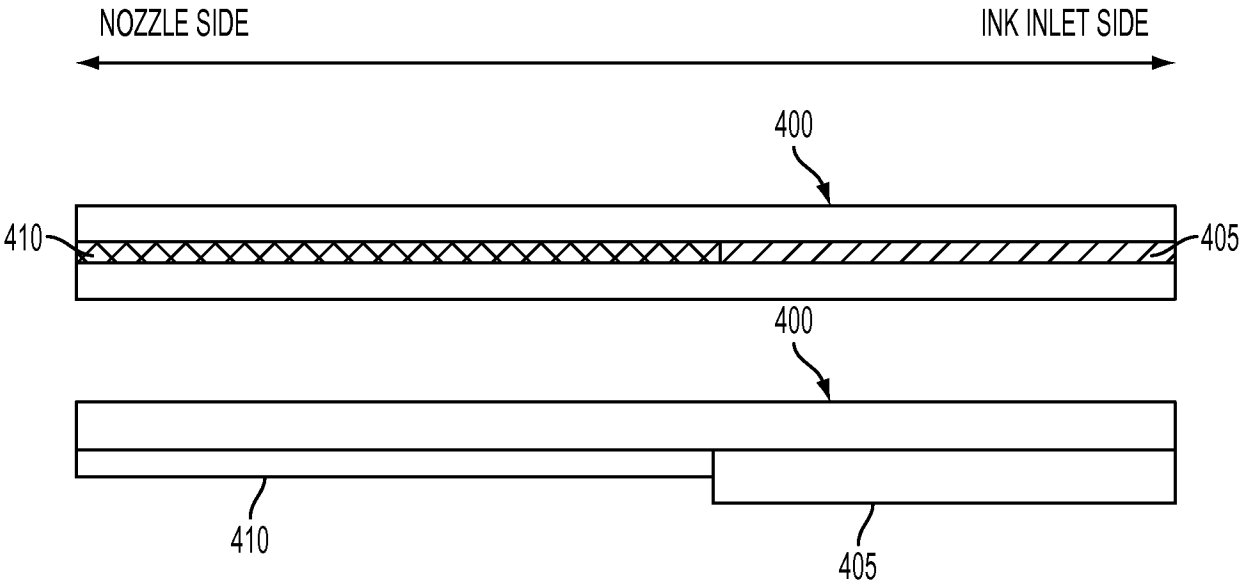
FIG. 4 depicts an exemplary polysilicon membrane employing a multi-height dimple according to the present teachings.

FIG. 4 depicts two views of an exemplary polysilicon membrane 400 employing a multi-height dimple. The top view as shown in FIG. 4 is a top view of the polysilicon membrane 400 and the bottom view as shown in FIG. 4 is a side view of the polysilicon membrane 400. In both views, the right side of the polysilicon membrane 400 corresponds to the side in which the ink feed is located, and the left side of the polysilicon membrane 400 corresponds to the side where the nozzle is located. Further, the polysilicon membrane 400 can include a taller dimple 405 located in the region near the ink feed and a shorter dimple 410 located in the region away from the ink feed (and near the nozzle). For example, the taller dimple 405 can be in a range of about 0.45 and 0.8 μm, and the shorter dimple 410 can be in a range of about 0.2 to 0.4 μm. It should be appreciated, however, that other heights can be used for the taller dimple 405 and the shorter dimple 410.

The taller dimple 405 can be employed near the ink feed because the ink feed end of the polysilicon membrane 400 can pull down before the nozzle end of the polysilicon membrane 400 when the voltage is applied to the actuator. The shorter dimple 410 can be employed near the nozzle end because the nozzle end of the polysilicon membrane 400 can pull down after the ink feed end of the polysilicon membrane 400 pulls down. The shorter dimple 410 can allow the membrane to more closely approach the electrode than the taller dimple 410 would and without exceeding the maximum electric field.

Figure 5A:
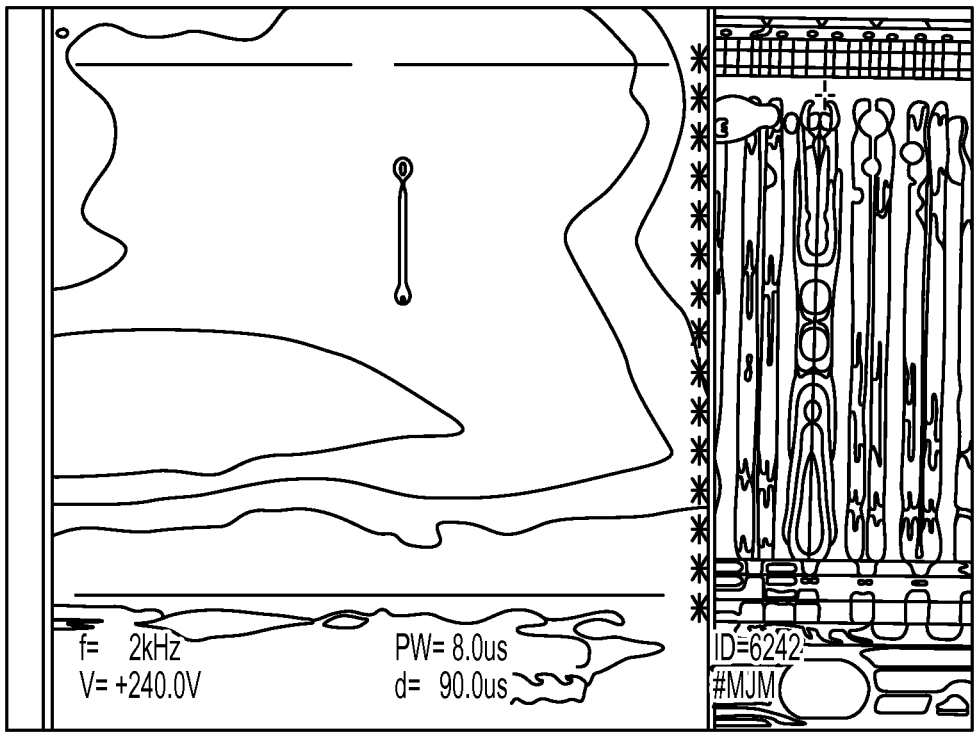
FIG. 5A depicts a schematic of an image of one or more ink droplets in flight after being ejected from an actuator.
Figure 5B:
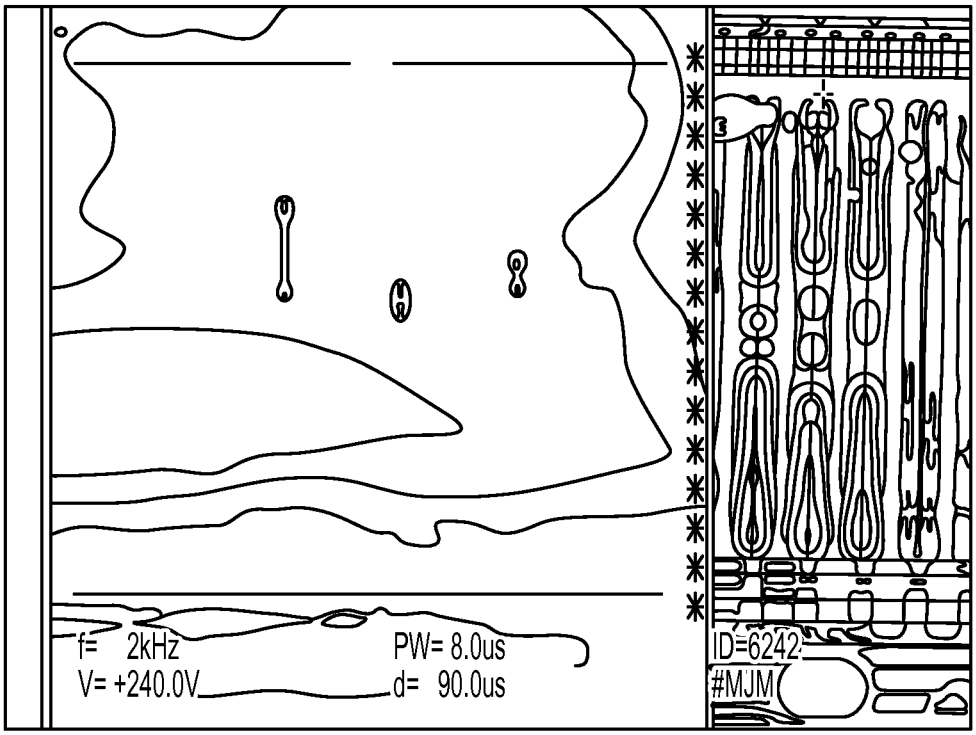
FIG. 5B depicts a schematic of an image of one or more ink droplets in flight after being ejected from an actuator.
Figure 5C:
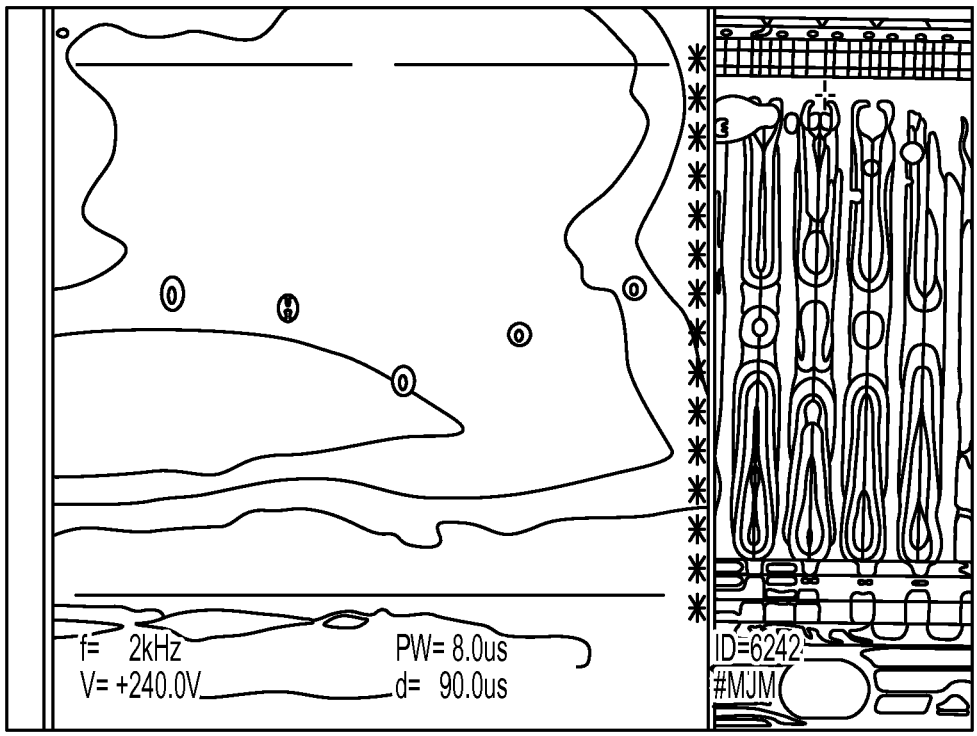
FIG. 5C depicts a schematic of an image of one or more ink droplets in flight after being ejected from an actuator.

FIGS. 5A-5C depict schematic line drawings taken from images of one or more ink droplets in flight after being ejected from an actuator. In particular, FIG. 5A depicts one ink drop being ejected from an actuator, FIG. 5B depicts three ink drops being ejected from three respective actuators, and FIG. 5C depicts five ink drops being ejected from five respective actuators. The schematics as depicted in FIGS. 5A-5C were taken from images of a printhead employing a square waveform, as discussed herein.

FIGS. 5A-5C each comprise two schematics of two images. The left side schematics of FIGS. 5A-5C depict the respective ink droplets in flight after being ejected from a nozzle face located at the bottom of the photograph, in the vicinity of the solid white line. The broken white line near the top of the images denotes a distance of 635 pm from the nozzle face, which roughly corresponds to the distance from a printhead to a drum that can be conventionally included in an ink jet printer.

The right side schematics of FIGS. 5A-5C depict a top-down view of a portion of the respective actuator array through a transparent Upilex nozzle plate. In the right side schematics, the drops were ejected towards the viewer of the corresponding images, with the ink feeds of the four depicted actuators at the bottom of the corresponding images and the nozzles at the top of the corresponding images. Illumination for the right side corresponding images was created by coherent light from a pulsed diode laser, and the laser pulse firing rate was synchronized to the drop ejection rate. Because the light was coherent, interference fringes can be seen and used to detect membrane deflection, shown as the rings in the respective right side schematics. The phase of the laser pulse was adjusted so that the laser pulse coincided with the time of maximum pulldown, or just before release. The actuators with visible membrane deflection as shown in the respective right side schematics correspond to the actuators that fired the ink drops as shown in the respective left side schematics. For example, the three actuators with membrane deflection in the right schematic of FIG. 5B correspond to three actuators that fired the three ink drops as shown in the left schematic of FIG. 5B.

As shown in the left side schematics of FIGS. 5A-5C, as the number of firing actuators increased, the speed and consistency in speed of the respective ink drops decreased. For example, as depicted in the left side schematic of FIG. 5B, the middle ink drop traveled at a slower speed than did the two outside ink drops. For further example, as depicted in the left side schematic of FIG. 5C, the middle ink drop traveled at a slower speed than did the other four ink drops, while the two outside ink drops traveled the fastest. These results indicate the crosstalk effect, as certain ink drops traveled slower than others as the number of firing actuators increased.

Further, as shown in the right side schematics of FIGS. 5A-5C, the relative amount of pulldown in the actuators decreased as the number of firing actuators increased. For example, as depicted in the right side schematic of FIG. 5B, the space between the rings in the middle actuator is greater than that of the two outside actuators, indicating that there was less pulldown in the middle actuator. For further example, as depicted in the right side schematic of FIG. 5C, the space between the rings in the middle actuator is greater than that of the three actuators, indicating that there was less pulldown in the middle actuator. As a result, as depicted in the right side schematics of both FIG. 5B and FIG. 5C, the middle ink drop ejected at a speed less than that of the other ink drops.

Figure 6:
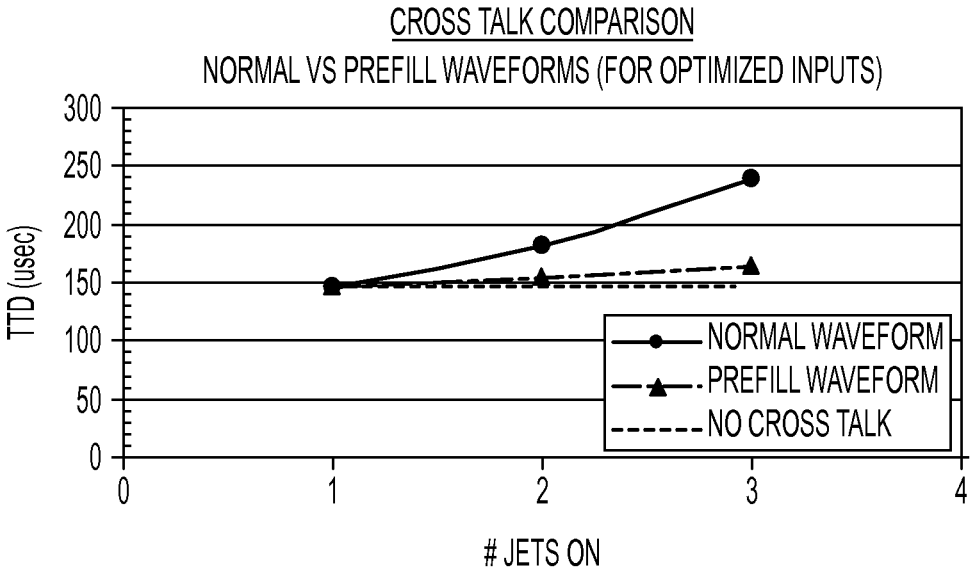
FIG. 6 is a graph depicting crosstalk comparison of a printhead with a pre-fill waveform application versus a printhead with a normal waveform application.

FIG. 6 is a graph depicting crosstalk comparison of a printhead with a pre-fill waveform application versus a printhead with a normal waveform application. The measurements contained in FIG. 6 were obtained using determined optimized inputs for the waveforms. In particular, a desired time-to-drum (TTD) of 150 μs was determined for a case with only the center actuator firing, in the case of both the normal waveform and the pre-fill waveform being applied to the center actuator. As understood in the art, TTD is the amount of time a drop takes to travel to the drum after exiting the actuator. For a normal waveform to produce a TTD of 150 μs, it was determined via a regression analysis that the fire pulse voltage need be set to about 185 V, and the fire pulse width be set to about 6.55 μs. Further, for a pre-fill waveform to produce a TTD of 150 μs, it was determined via a regression analysis that the fire pulse voltage need be set to about 199.7 V, the fire pulse duration be set to about 6.82 μs, and the pre-fill voltage be set to about 133.87 V.

The normal and pre-fill waveform inputs were used to perform test cases for three scenarios: the case with only one center actuator enabled (1-actuator on), the case with the center actuator and one adjacent actuator enabled (2-actuators on), and the case with the center actuator and both adjacent actuators enabled (3-actuators on). The TTD of the center actuator was measured in all three test scenarios. As shown in FIG. 6, the TTD for the normal waveform application is about 150 μs for the 1-actuator on scenario, about 184μs for the 2-actuator on scenario, and about 242 μs for the 3-actuator on scenario. In contrast, as shown in FIG. 6, the TTD for the pre-fill waveform application is about 148 μs for the 1-actuator on scenario, about 153 μs for the 2-actuator on scenario, and about 165 μs for the 3-actuator on scenario. The results indicated that the crosstalk effect was reduced when the pre-fill waveform was applied instead of the normal waveform because the TTD of the center actuator increased by about 31 μs in the 2-actuator on case and by about 77 μs in the 3-actuator on case.

FIG. 7 is a chart detailing modeling results for different dimple configurations and waveforms. In particular, FIG. 7 details electric field, TTD, and drop size of an actuator system for the different configurations and different applied waveforms (single or dual). The measurements contained in FIG. 7 were obtained by applying certain inputs to an actuator system, and it should be understood that different actuator systems could yield different results. In particular, the actuator configuration as used in obtaining the measurements detailed in FIG. 7 comprised a nozzle of height 25 pm, diameter 25 μm, and taper angle 0°; a fire pulse voltage of 200 V; a fire pulse duration of 6 μs; and a frequency of 10,000 Hz. Further, in the cases in which a dual waveform was used, the second voltage duration was 2 μs. In addition, Dimple1 extended from the nozzle to 800 μm away from the nozzle, and Dimple2 extended from between 800-1200 μm away from the nozzle.

As detailed in FIG. 7, the implementation of a taller (0.7 μm) Dimple2 reduced the electric field from about 400 V/μm to about 300 V/μm. However, the actuator system experienced a performance reduction in the cases with the single waveform, as the TTD and drop size of the ejected drops reduced in performance. However, as indicated in the last entry of FIG. 7, the dual waveform and the taller Dimple2 configuration improved the performance in each of TTD, drop size, and electric field as compared to the single waveform and shorter Dimple2 configuration.

While the invention has been illustrated with respect to one or more exemplary embodiments, alterations and/or modifications can be made to the illustrated examples without departing from the spirit and scope of the appended claims. In addition, while a particular feature of the invention may have been disclosed with respect to only one of several embodiments, such feature may be combined with one or more other features of the other embodiments as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." And as used herein, the term "one or more of" with respect to a listing of items, such as, for example, "one or more of A and B," means A alone, B alone, or A and B.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An inkjet printing system comprising:

an actuator comprising a landing pad, a set of electrodes for transmitting a voltage waveform to the actuator, and a membrane with a multi-height dimple, wherein the dimple comprises a first section laterally extending on a first region of the membrane and a second section laterally extending on a second region of the membrane, wherein the first section has an associated height greater than an associated height of the second section, the first section is disposed proximal to an ink inlet end of the actuator, and the second section is disposed proximal to a nozzle of the actuator, and wherein the membrane is configured to be electrostatically pulled toward the set of electrodes when the voltage waveform is applied to the actuator.

2. The system of claim 1, wherein the voltage waveform comprises a first voltage applied for a first amount of time and a step-down voltage applied for a second amount of time, wherein the step-down voltage is less than the first voltage.

3. The system of claim 1, wherein the height of the first section is in a range of about 0.65 μm to about 0.75 μm and the height of the second section is in a range of about 0.45 μm to about 0.55 μm.

4. The system of claim 1, wherein the height of the first section and the height of the second section is based on a maximum tolerable electrical field.

5. The system of claim 1, wherein the membrane is configured to be pulled non-uniformally when the voltage waveform is applied to the actuator.

6. The system of claim 5, wherein the membrane is configured to be pulled such that the first region of the membrane is pulled before the second region of the membrane is pulled when the voltage waveform is applied to the actuator.

7. The system of claim 1, wherein the first region is about ⅓ of a length of the membrane and the second region is about ⅔ of the length of the membrane.

8. The system of claim 1, wherein the membrane comprises a polysilicon membrane.

9. The system of claim 1, wherein a portion of the dimple comprising the second section is configured to rest against the landing pad when the voltage waveform is applied to the actuator.

10. The system of claim 1, wherein in the landing pad is located between the set of electrodes.

* * * * *